US006151749A

United States Patent [19]

Berfield

[11] Patent Number: 6,151,749

[45] Date of Patent: Nov. 28, 2000

[54] USER-CARRIED VACUUM CLEANER

[75] Inventor: Robert C. Berfield, Jersey Shore, Pa.

[73] Assignee: Shop Vac Corporation, Williamsport, Pa.

[21] Appl. No.: 09/425,777

[22] Filed: Oct. 22, 1999

[51] Int. Cl.[7] ..... A47L 5/36

[52] U.S. Cl. ..... 15/327.5; 15/339

[58] Field of Search ..... 15/327.5, 339, 15/412

[56] References Cited

U.S. PATENT DOCUMENTS

| | | | |
|---|---|---|---|
| D. 312,517 | 11/1990 | Hohrein, II et al. . | |
| D. 315,234 | 3/1991 | Frisell . | |
| D. 326,747 | 6/1992 | Stickle . | |
| 1,047,164 | 12/1912 | Butenschoen . | |
| 1,099,560 | 6/1914 | Matchette . | |
| 1,255,662 | 2/1918 | Sullivan | 15/327.5 |
| 2,392,205 | 1/1946 | Wales . | |
| 3,308,608 | 3/1967 | Brimberg . | |
| 4,461,055 | 7/1984 | Zerrer et al. . | |
| 4,569,100 | 2/1986 | Purkapile . | |
| 4,662,551 | 5/1987 | Dudley et al. . | |
| 4,921,143 | 5/1990 | Billet . | |
| 4,944,065 | 7/1990 | Svanberg et al. . | |
| 5,195,208 | 3/1993 | Yamami et al. . | |
| 5,195,209 | 3/1993 | Watkins . | |
| 5,588,177 | 12/1996 | Eriksen . | |
| 6,049,941 | 4/2000 | Vollenweider | 15/327.5 |

FOREIGN PATENT DOCUMENTS

| | | | |
|---|---|---|---|
| 1428497 | 3/1969 | Germany | 15/327.5 |

*Primary Examiner*—Chris K. Moore
*Attorney, Agent, or Firm*—Marshall, O'Toole, Gerstein, Murray & Borun

[57] ABSTRACT

A vacuum cleaner includes a backpack enclosure that removably encloses an impeller/motor unit. The backpack enclosure has a substantially block-shaped outer configuration and is made from a pliable cloth material, preferably composed of woven NYLON fibers. Two shoulder straps are attached to the backpack enclosure for carrying the vacuum cleaner. In accordance with an alternative embodiment of the invention, a vacuum cleaner includes a fanny pack enclosure that removably encloses an impeller/motor unit. The fanny pack enclosure is made from a pliable cloth material, preferably composed of woven NYLON fibers. A harness in the form of a waist strap is attached to the fanny pack enclosure for carrying the vacuum cleaner on the waist of a user.

15 Claims, 2 Drawing Sheets

USER-CARRIED VACUUM CLEANER

FIELD OF THE INVENTION

The present invention relates to vacuum cleaners, and more particularly to vacuum cleaners that are adapted to be supported by a user's body, while leaving the user's hands substantially unencumbered (e.g., so that the user's hands are free to manipulate a hose connected to the vacuum cleaner).

BACKGROUND ART

Typically, vacuum cleaners used in domestic and commercial environments are supported directly by the floor surface. Such vacuum cleaners typically include wheels mounted to the vacuum cleaner to facilitate mobility of the vacuum cleaner. One drawback of such floor-supported vacuum cleaners is that a relatively long and cumbersome vacuum hose is required to make it easier to clean elevated surfaces such as shelves, drapes, stairways and the like.

Accordingly, vacuum cleaners have been developed that are designed to be carried by the user. Examples of such hand-held vacuum cleaners include hand-held vacuum cleaners, such as the MIGHTY MINI brand vacuum cleaner marketed by the assignee of the present invention and the DUSTBUSTER brand vacuum cleaner marketed by Black & Decker Inc. Such Known hand-held vacuum cleaners have been successful for relatively light-duty cleaning.

There is also a need for more powerful, and therefore heavier, vacuum cleaners that may be carried by the user to make it easier for the user to thoroughly clean surfaces such as shelves, drapes stairways and the like, that are not well suited for cleaning with ground-supported vacuum cleaners. It is especially desirable to enhance the mobility of the vacuum cleaner by designing the vacuum cleaner to be readily carried by the user, while leaving the user's hands substantially unencumbered (e.g., so that the user's hands are free to manipulate a hose connected to the vacuum cleaner). U.S. Pat. Nos. 1,047,164, 1,099,560, 2,392,205, 3,308,608, 5,588,177, Des. 312,571, Des. 326,747, disclose vacuum cleaners that may be carried by the user using shoulder straps attached to the vacuum cleaner.

However, it is also desirable to have a vacuum cleaner that is removably held in a pliable enclosure, such as a backpack enclosure, or alternatively, a fanny pack enclosure. By holding the vacuum cleaner in a pliable enclosure, the user can be better isolated from dust and dirt that is collected by the vacuum cleaner. In this regard, it is also desirable to have a vacuum cleaner that has a dirt receptacle enclosed within the pliable backpack enclosure, or alternatively, within the pliable fanny pack enclosure.

SUMMARY OF THE INVENTION

In accordance with one aspect of the present invention, a vacuum cleaner comprises an impeller/motor unit, a pliable enclosure adapted to removably enclose and support the impeller/motor unit and adapted to be carried by a user, and at least one carrying strap attached to the pliable enclosure. The pliable enclosure is preferably made from a woven cloth material, comprising, for example, NYLON fibers and preferably has a substantially block-shaped outer configuration.

In accordance with another aspect of the present invention, a vacuum cleaner, adapted to be carried by a user, comprises an impeller/motor unit, a pliable container, removably housing the impeller/motor unit, and a harness, attached to the pliable container.

In accordance with yet another aspect of the present invention, a vacuum cleaner, adapted to be carried by a user, comprises an impeller/motor unit and a collection tank, a pliable container, housing the impeller/motor unit and the collection tank, and a harness, attached to the pliable container.

Other features and advantages are inherent in the vacuum cleaner claimed and disclosed or will become apparent to those skilled in the art from the following detailed description in conjunction with the accompanying drawings.

DESCRIPTION OF THE PREFERRED EMBODIMENTS

Figures 1, 2:
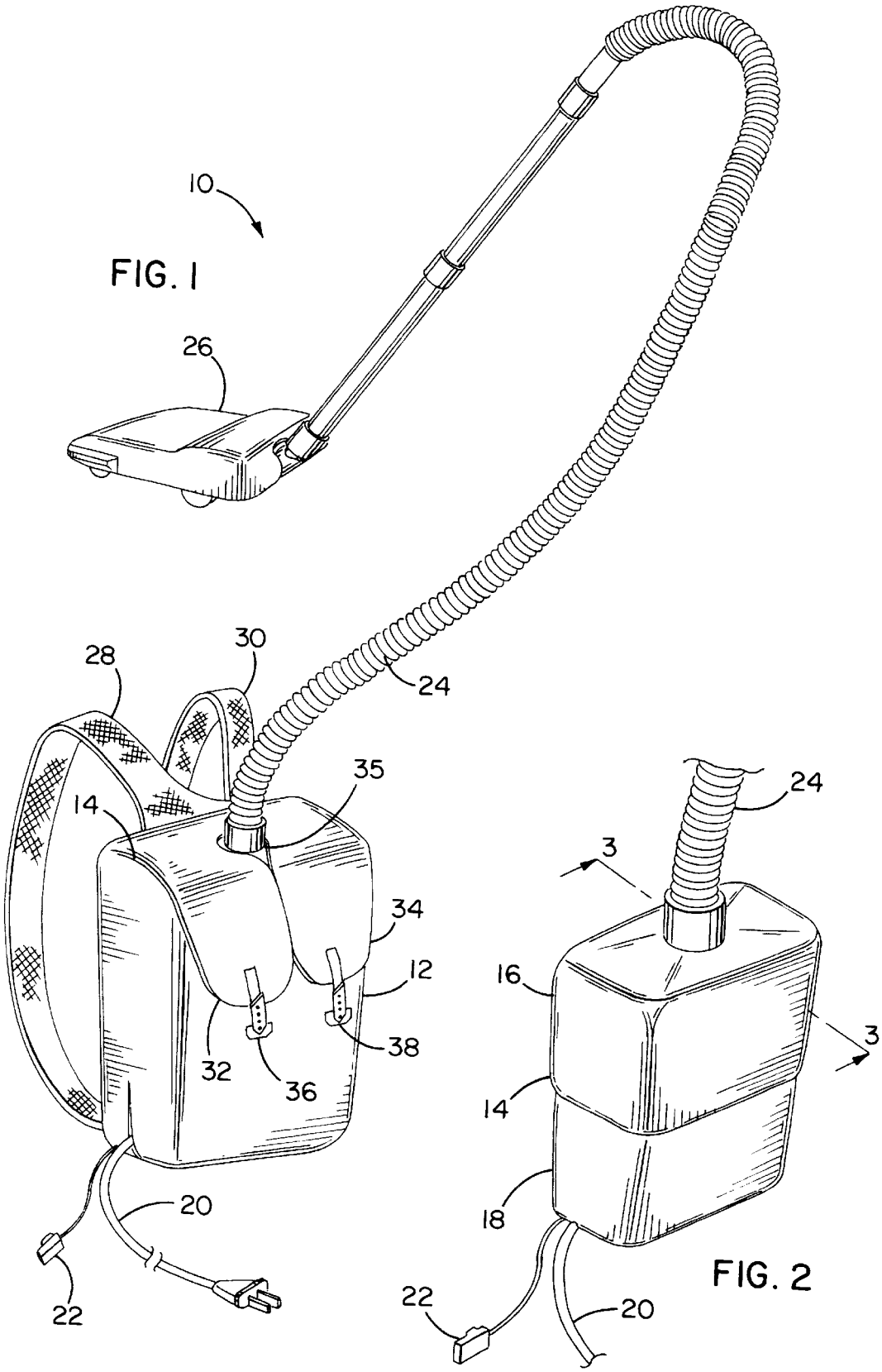
FIG. 1 is a perspective view of a vacuum cleaner in accordance with the present invention.
FIG. 2 is a fragmentary perspective view of an impeller/motor unit of the vacuum cleaner of FIG. 1.
Figure 3:
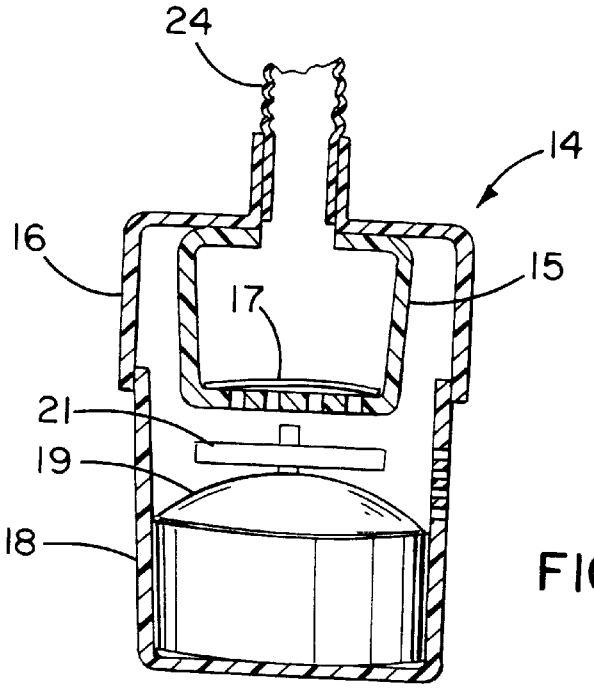
FIG. 3 is a cross-sectional view, taken generally along lines 3—3 of FIG. 2, of the impeller/motor unit.

Referring initially to FIGS. 1 and 2, a vacuum cleaner according to invention, indicated generally at 10, includes a backpack enclosure 12 that removably encloses an impeller/motor unit 14 (FIG. 2). The impeller/motor unit 14 includes an upper portion 16, that contains a collection tank 15 and a filter 17 (shown in FIG. 3), and a lower portion 18, that contains a motor 19 and impeller 21 (shown schematically in FIG. 3). A power cord 20 and power switch 22 are connected to the vacuum cleaner 10 in a conventional manner. A vacuum hose 24 extends from the impeller/motor unit 14 to a nozzle unit 26, also in a conventional manner.

The backpack enclosure 12 has a substantially block-shaped outer configuration and is made from a pliable cloth material, preferably composed of woven NYLON fibers. Two shoulder straps, 28 and 30, are attached to the backpack enclosure 12, and together form a harness for carrying the vacuum cleaner 10. The backpack enclosure includes closure flaps 32 and 34, that together define a teardrop-shaped opening 35, through which the vacuum hose 24 passes. The closure flaps 32 and 34 may be opened by the use of clasps 36 and 38, respectively. By opening the closure flaps 32 and 34, the user may conveniently remove the impeller/motor unit 14 from the backpack enclosure 12, for example, in order to empty the collection tank 15 or in order to utilize the vacuum cleaner 10 without the backpack enclosure 12 (e.g., when cleaning a relatively small area of a floor surface).

Figure 4:
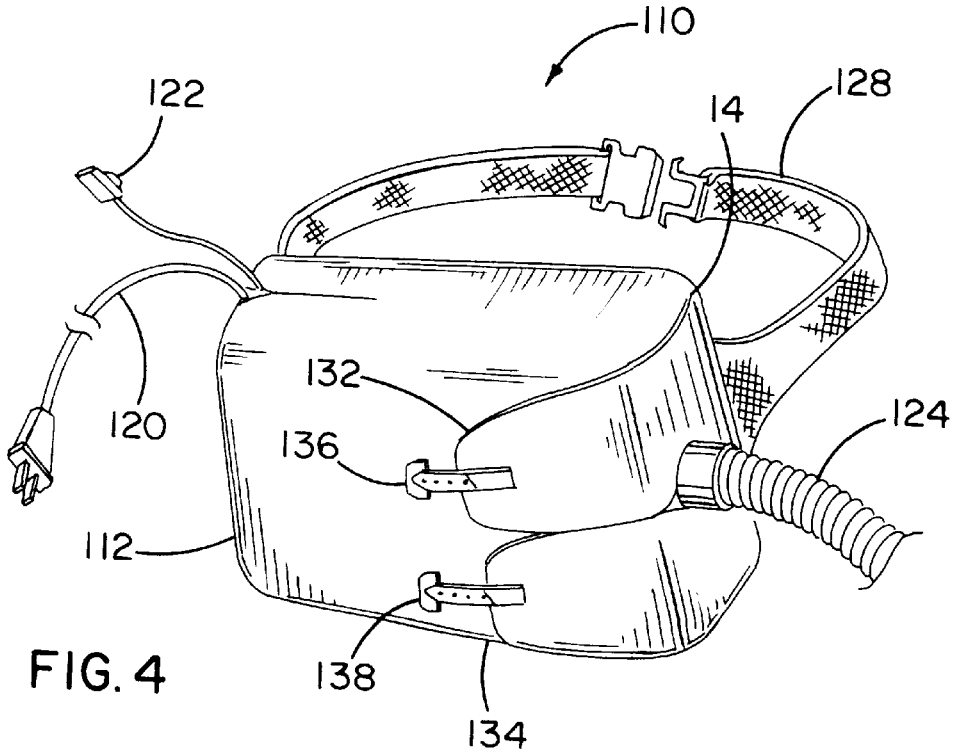
FIG. 4 is a perspective view of an alternative embodiment of a vacuum cleaner in accordance with the present invention.

FIG. 4 shows an alternative embodiment of the invention in which a vacuum cleaner indicated generally at 110 is shown. The vacuum cleaner 110 is substantially the same as the vacuum cleaner 10 shown in FIGS. 1 and 2, except that the vacuum cleaner 110 includes a fanny pack enclosure 112 (instead of the backpack enclosure 12) that encloses an impeller/motor unit 114. A power cord 112 and power switch 122 are connected to the vacuum cleaner 110 in a conventional manner. A vacuum hose 124 extends from the impeller/motor unit 114 in a conventional manner.

The fanny pack enclosure 112 is made from a pliable cloth material, preferably composed of woven NYLON fibers. A harness in the form of a waist strap 128 is attached to the fanny pack enclosure 112 for carrying the vacuum cleaner 110 on the waist of a user. The fanny pack enclosure includes closure flaps 132 and 134 that may be opened by the use of clasps 136 and 138, respectively. By opening the closure flaps 132 and 134, the user may conveniently remove the impeller/motor unit 114 from the fanny pack enclosure 112, for example, in order to empty the collection tank (not shown in FIG. 4) or in order to utilize the vacuum cleaner 110 without the fanny pack enclosure 112 (e.g., when cleaning a relatively small area of a floor surface).

The foregoing detailed description has been given for clearness of understanding only, and no unnecessary limitations should be understood therefrom, as modifications would be obvious to those skilled in the art.

What is claimed is:

1. A vacuum cleaner comprising:

an impeller/motor unit;

a pliable enclosure adapted to be carried by a user;

a rigid housing removably positioned in the pliable enclosure, the impeller/motor unit being positioned within the rigid housing;

at least one carrying strap attached to the pliable enclosure.

2. The vacuum cleaner of claim 1, wherein the pliable enclosure is made from a woven cloth material.

3. The vacuum cleaner of claim 2, wherein the woven cloth material comprises NYLON fibers.

4. The vacuum cleaner of claim 1, wherein the pliable enclosure has a substantially block-shaped outer configuration.

5. A vacuum cleaner, adapted to be carried by user, comprising:

an impeller/motor unit;

a pliable container;

a rigid housing removably positioned in the pliable container, the impeller/motor unit being positioned within the rigid housing;

a harness, attached to the pliable container.

6. A vacuum system, comprising:

a body harness; and a self-contained vacuum cleaner removably mounted in the body harness, the self-contained vacuum cleaner being operable in first and second modes, the self-contained vacuum cleaner being positioned within the body harness when in the first mode, the vacuum cleaner being removed from the body harness when in the second mode.

7. The vacuum system of claim 6 wherein the self-contained vacuum cleaner includes a housing, the housing including a waste receptacle and a vacuum generation mechanism.

8. The vacuum system of claim 7 wherein the vacuum generation mechanism includes a motor driven impeller.

9. The vacuum system of claim 6 wherein the body harness is a backpack.

10. The vacuum system of claim 6 wherein the body harness is a fanny pack.

11. The vacuum system of claim 6 wherein the body harness is adapted to completely enclose the self-contained vacuum cleaner when in the first mode.

12. A vacuum cleaner comprising:

an impeller/motor unit;

a pliable enclosure adapted to removably enclose and support the impeller/motor unit and to be carried by a user, the vacuum cleaner being operable when the impeller/motor unit is enclosed within the pliable enclosure and when removed from the pliable enclosure; and at least one carrying strap attached to the pliable enclosure.

13. The vacuum cleaner of claim 12, wherein the pliable enclosure is made from a woven cloth material.

14. The vacuum cleaner of claim 13, wherein the woven cloth material comprises NYLON fibers.

15. The vacuum cleaner of claim 12, wherein the pliable enclosure has a substantially block-shaped outer configuration.

* * * * *